US005778487A

United States Patent [19]

Schuld

[11] Patent Number: 5,778,487

[45] Date of Patent: Jul. 14, 1998

[54] VACUUM CLEANING MACHINE

[76] Inventor: Ernest R. Schuld, 109 Jana Rd., Macomb, Ill. 61455

[21] Appl. No.: 349,437

[22] Filed: Dec. 5, 1994

[51] Int. Cl.[6] ..... A47L 5/36

[52] U.S. Cl. ..... 15/352; 15/327.6; 55/378

[58] Field of Search ..... 15/347, 327.1, 15/327.6, 327.7, 352; 55/374, 376, 378

[56] References Cited

U.S. PATENT DOCUMENTS

| | | | |
|---|---|---|---|
| 2,652,902 | 9/1953 | Sheahan | 15/324.6 X |
| 2,769,997 | 11/1956 | Sheahan | 15/327.5 X |
| 4,739,535 | 4/1988 | Schuld et al. | 15/315 |

FOREIGN PATENT DOCUMENTS

| | | | |
|---|---|---|---|
| 204554 | 11/1956 | Australia | 15/327.6 |
| 88208 | 10/1956 | Norway | 15/327.6 |
| 179295 | 5/1962 | Sweden | 15/327.6 |

*Primary Examiner*—Chris K. Moore
*Attorney, Agent, or Firm*—Trexler, Bushnell, Giangiorgi & Blackstone, Ltd.

[57] ABSTRACT

A vacuum cleaner machine includes a housing having an open upper end and a partition member therein which defines first and second vacuum chambers, a bag holder in said housing and a dome covering the open end of the housing. The bag holder is positioned in the first chamber and retains a bag therein. The bag has a nozzle inlet. The dome has a hose aperture extending therethrough and a nozzle fitting extending therefrom and is positioned on top of the bag holder and over the open end of the housing so that the nozzle fitting extends through the aperture in the bag. A vacuum hose has a hose cuff at one end which is releasably insertable into the hose fitting. A suction unit is mounted in the second chamber and has an inlet which communicates with the vacuum chamber.

24 Claims, 5 Drawing Sheets

VACUUM CLEANING MACHINE

BACKGROUND OF THE INVENTION

The present invention relates to a novel cleaning apparatus and more particularly to improvements to a novel vacuum cleaner.

Prior U.S. Pat. No. 4,739,535 relates to a vacuum cleaning machine for fireplaces and the like. The vacuum cleaner covered by the aforementioned patent includes a decorative canister or housing member having a vacuum chamber containing a fire-retardant dust bag, a blower and an electric motor unit and a storage chamber having reels for an electric cord and flexible vacuum hose.

The prior art vacuum cleaner is suitable for use in removing dust and ash from the fireplace without stirring up the ash in a manner to cause it to disperse out into the room surrounding the fireplace.

However, the prior art vacuum cleaner has an inlet nozzle on one side of the cleaner. The side location of the inlet nozzle reduces the useable vac and bag capacity. Further, the inlet nozzle protrudes into the vacuum chamber interfering with the removal of the filter bag filled with ashes. Once the filter bag has become full, it is somewhat difficult to remove the bag from the cleaner without dispersing ash into the room.

It is an object of the present invention to provide an improved novel vacuum cleaner suitable for use in cleaning fireplaces, which has an inlet nozzle located at the top of the housing member of the vacuum cleaner.

Still another object of the present invention is to provide a novel vacuum cleaner which has means to improve the capacity of the bag and improve the ease of installing and removing the filter bag.

A more specific object of the present invention is to provide a novel vacuum cleaner having a container in which is located an electric motor driven blower and a dust and ash collecting bag, which cleaner also includes a flexible hose removably connected to an inlet in the top of a filter and a removable bag holder releasably connected to the filter bag which can be readily lifted out of the container and carried to the garbage.

BRIEF DESCRIPTION OF THE DRAWINGS

Further, objects and advantages of the present invention will become apparent from the following description and accompanying drawings wherein.

DETAILED DESCRIPTION OF THE ILLUSTRATED EMBODIMENT

Figure 1:
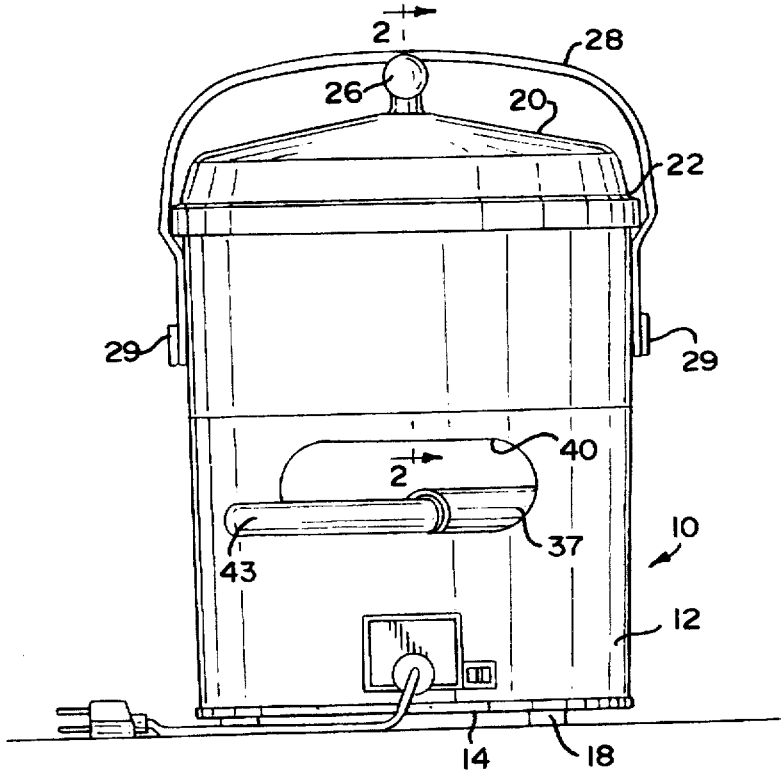
FIG. 1 is a side elevational view showing a novel vacuum cleaner incorporating the features of the present invention.
Figure 2:
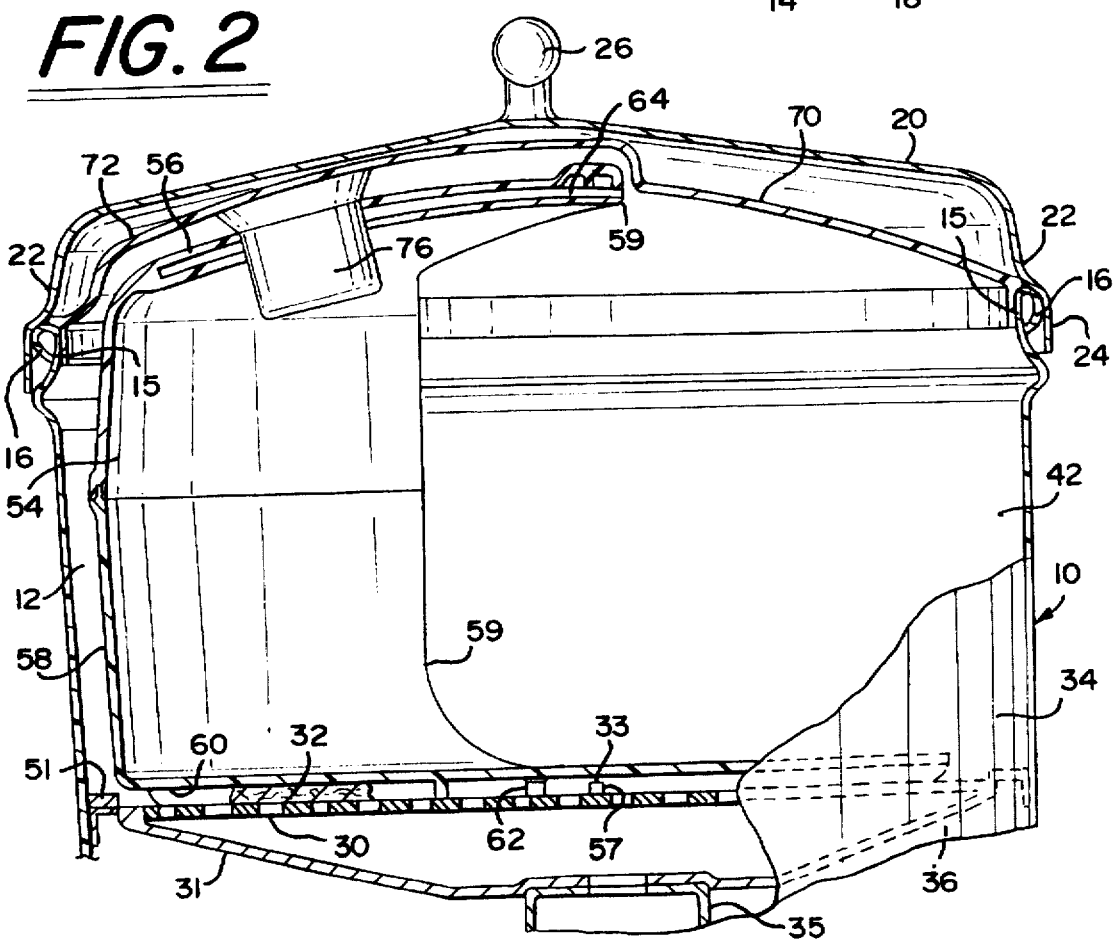
FIG. 2 is an enlarged partial sectional view along line 2—2 in FIG. 1.
Figure 3:
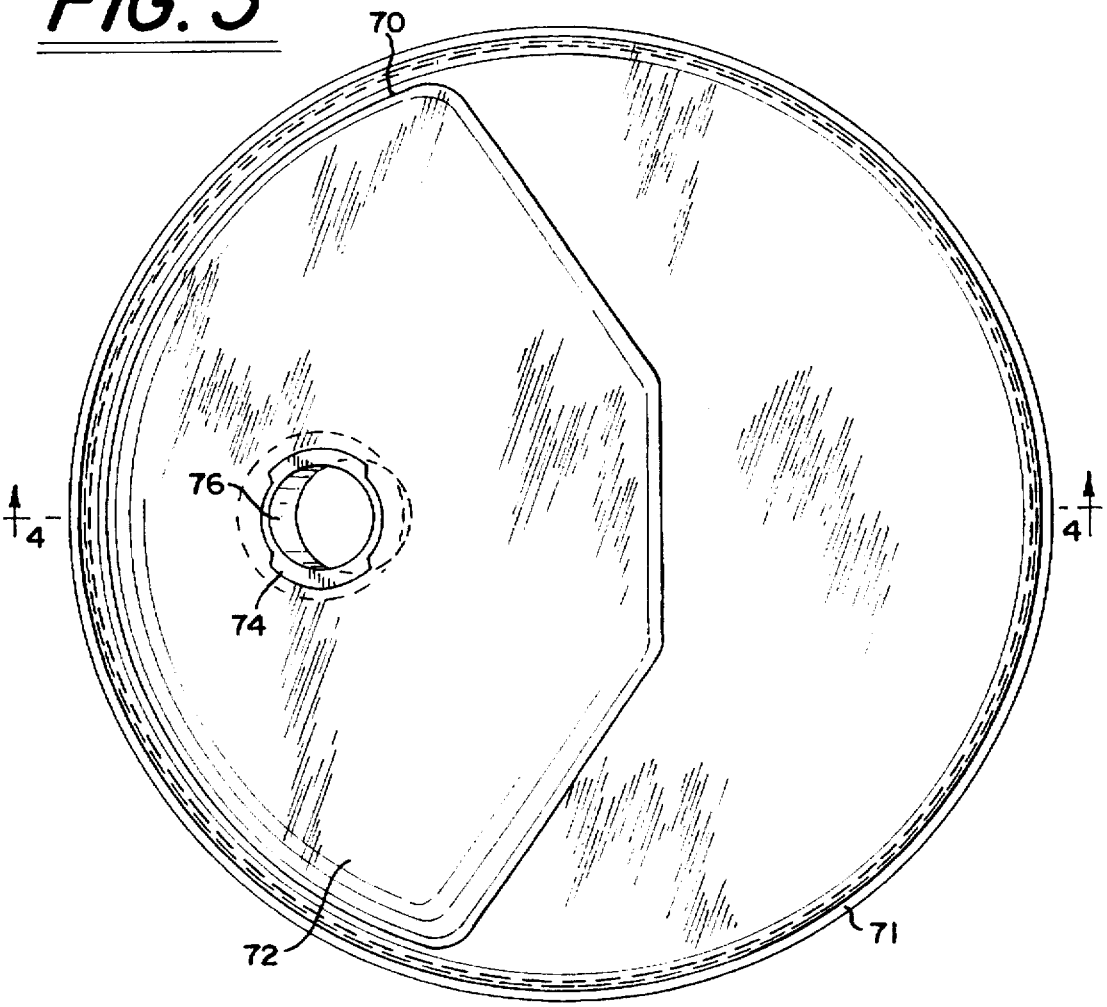
FIG. 3 is a plan view of an inner cover included in the novel vacuum cleaner of the present invention.
Figure 4:
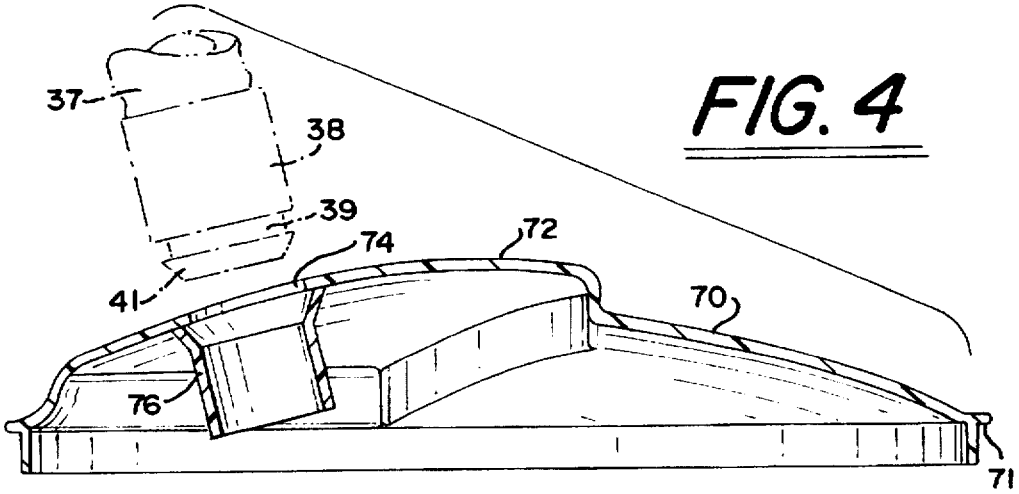
FIG. 4 is a sectional view taken along line 4—4 in FIG. 3 and further showing a hose before it is inserted in inlet means in the inner cover or closure.
Figure 5:
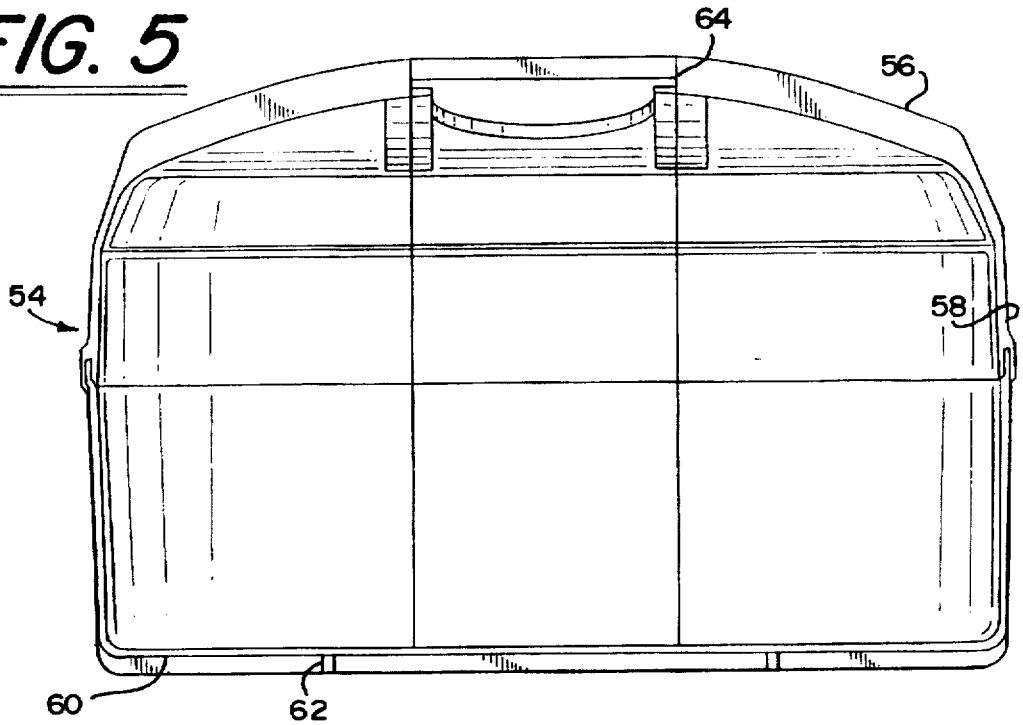
FIG. 5 is an enlarged front elevational view of a bag holder according to the present invention.
Figure 6:
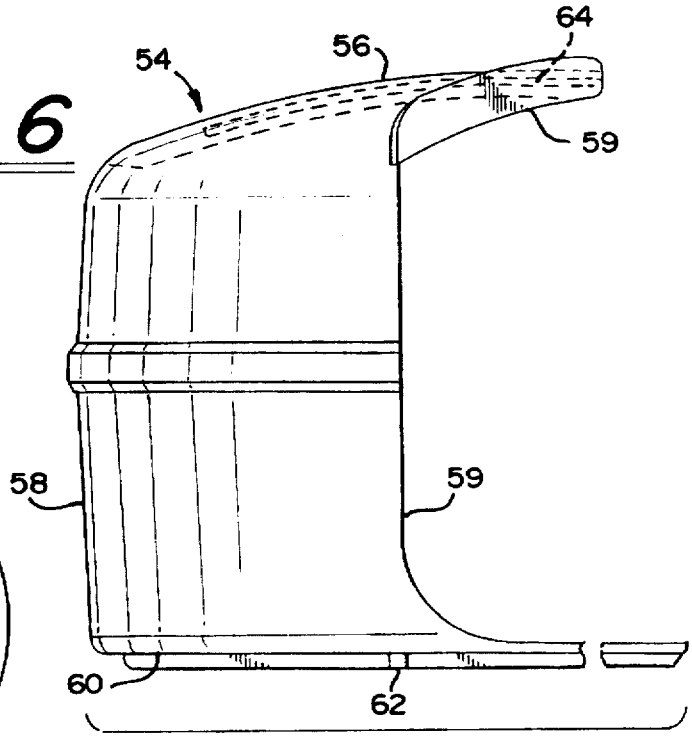
FIG. 6 is an enlarged side elevational view of the bag holder.
Figure 7:
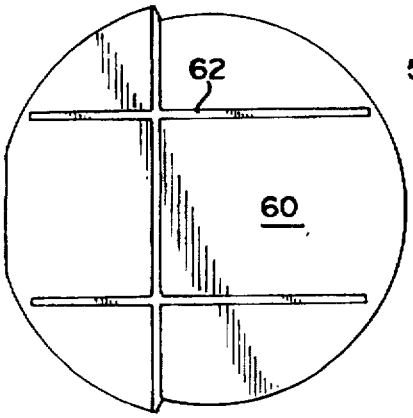
FIG. 7 is a bottom view, on a reduced scale, of the bag holder.

Referring now more specifically to the drawings wherein like parts are designated by the same numerals throughout the various figures, a vacuum cleaner 10 incorporating features of the present invention is shown best in FIGS. 1 and 2. The cleaner 10 comprises a cylindrical housing or container member 12 having a closed bottom wall 14 and an open upper mouth 15 defined by rim 16.

Feet 18 are secured at spaced intervals around the periphery of the bottom wall 14.

A decorative cover or lid 20 is provided for closing the mouth 15 of the housing 12 when the vacuum cleaner is not in use. The lid 20 includes a depending peripheral flange portion 22 which extends around the rim 16 of the housing 12. The flange 22 has an annular shoulder 24 for effectively engaging and sealing the rim 16. The cover includes a decorative knob 26. A handle 28 is secured to the housing by pivot elements 29. When the vacuum cleaner is in use, the lid 20 is removed.

Although the vacuum cleaner housing is shown in cylindrical form, it is understood that the invention can be used in any type of vacuum cleaner.

As shown in FIG. 2, a first perforated partition or divider wall 30 rests on a dished or coned second solid partition 31. As will be described in detail below, the perforated partition 30 supports a secondary filter 32. The first or upper partition 30 and second or lower partition 31 divide the housing into a first or upper vacuum chamber 34 and a second or lower chamber 36. A suction unit 35 is mounted within the lower chamber 36. The suction unit includes an electrical motor of known construction operatively connected to a blower also of known construction. The blower has an inlet located at the upper end thereof. The suction unit and blower are described in detail in prior U.S. Pat. No. 4,739,535. The lower panel 31 is sealed to the lower chamber 36 housing by fasteners or adhesive or other suitable means, and is secured in place within the lower chamber 36 by gasket 51 to complete the vacuum chamber area. The air is drawn through the primary filter bag (discussed below) and the secondary filter 32 on operation through the motor into lower vacuum chamber 36. Also as disclosed in the prior patent, a reel means is provided in lower chamber 36 to receive and retain a vacuum hose 37 when the hose 37 is not in use. The hose 37 includes a hose cuff 38 at one end. As will be discussed below, in one embodiment of the invention the hose cuff 38 has a reduced cylindrical portion 39. The reduced portion 39 has a locking flange 41. An opposite end of the hose 37 is adapted to receive a nozzle 43 as described in the prior patent.

Further, an opening 40 is formed in one side of the housing 12 through which the hose 37 may be inserted and retracted. The opening 40 also provides an exhaust port for the air which is delivered to the lower chamber 36.

Figure 8:
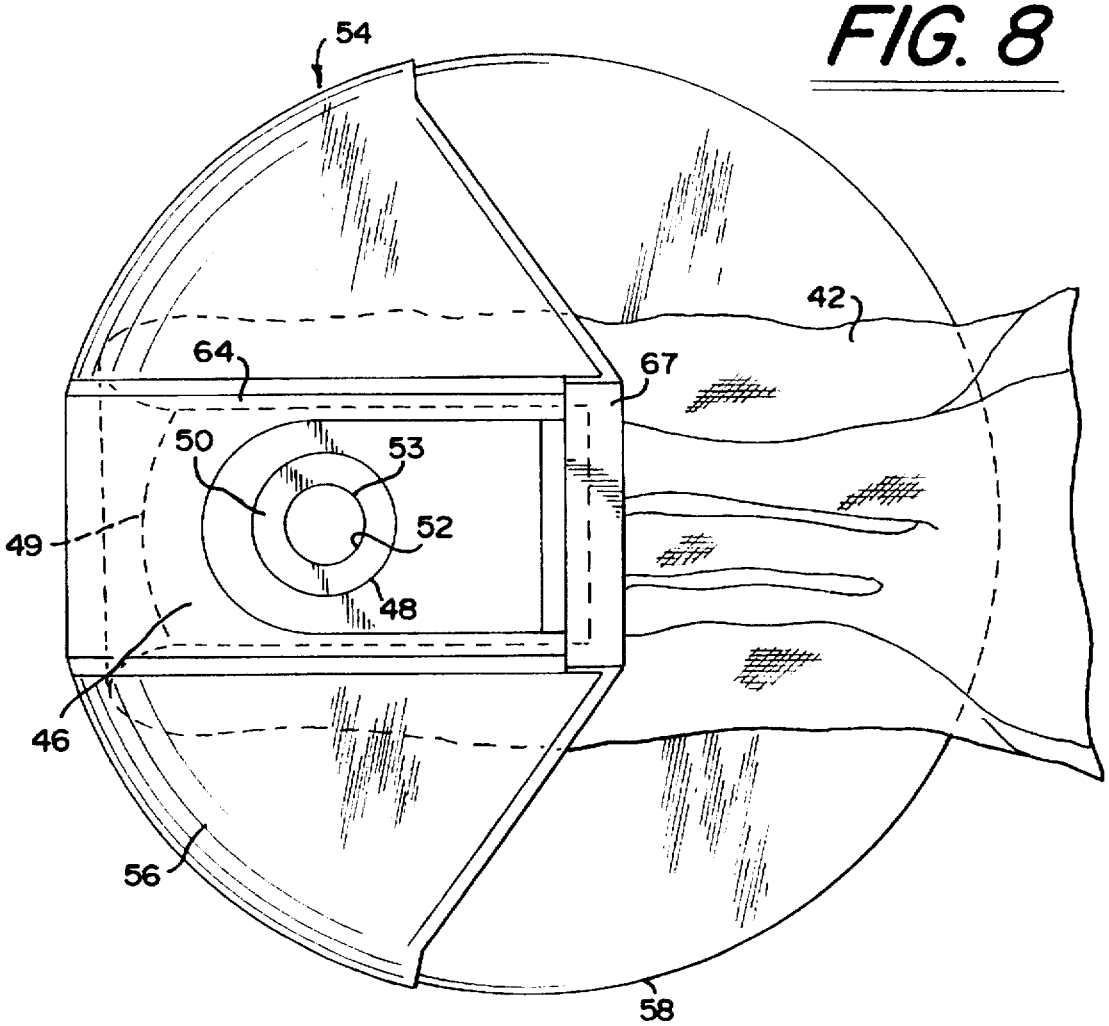
FIG. 8 is an enlarged top plan view of the bag holder with an assembled dust bag.
Figure 9:
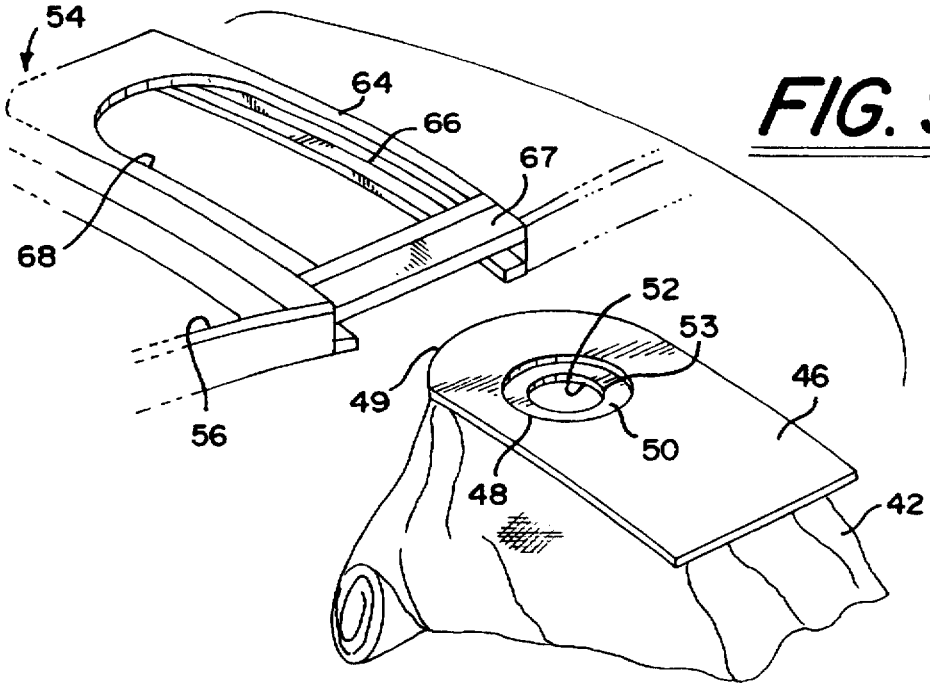
FIG. 9 is an enlarged exploded fragmentary view of a dust bag and the bag holder.

The cleaner 10 is provided with a primary dust and ash collection bag 42 positioned in the vacuum chamber 34 as shown best in FIGS. 2, 8 and 9. The bag 42 is constructed of known paper or other filtering material which is adapted to be impervious to dust and the like. The bag 42 is coated or impregnated with a fire retardant substance as described in prior U.S. Pat. No. 4,739,535.

As set forth above, a secondary filter 32 rests on the perforated panel 30. The secondary filter 32 prevents ash or dust from entering the motor in the event the primary bag 42 ruptures. The secondary filter 32 is also fire retardant and is held in place by a centering pin 33 which compliments a preformed aperture 57 in secondary filter 32.

Figure 11:
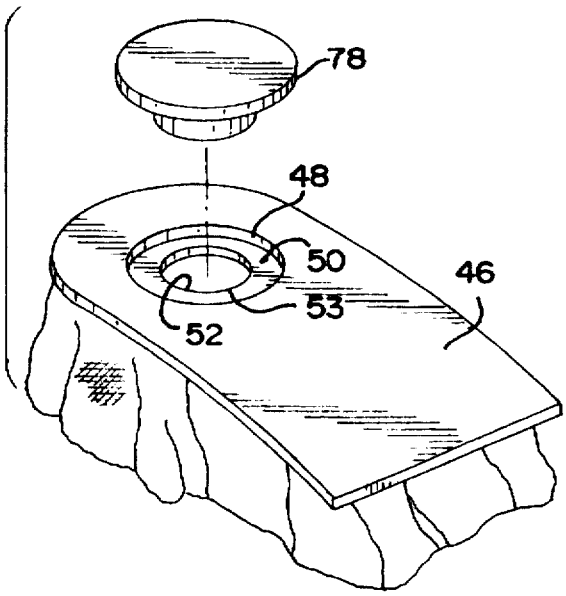
FIG. 11 is an exploded fragmentary view of a filter bag plug and the filter bag entry card; and, FIG. 12 is an exploded fragmentary view of an alternative embodiment hose cuff, fitting cap and mating tapered locking entry connection of the inner dome cover.

The paper of other filtering material of the bag 42 is connected or secured by adhesive or other suitable means to a cardboard or plastic member or card 46 as shown best in FIGS. 8, 9 and 11. The card 46 has an aperture 48 therethrough and is adapted to receive the inner cover nozzle fitting 76, as will be discussed below. As shown in this embodiment, one end 49 of the card 46 is curved or rounded. A thin backing or sheet 50 is secured to the bottom of the card 46 as shown in FIGS. 8 and 9. The sheet 50 is preferably made of a rubber material or similar flexible or resilient material. The rubber sheet 50 also includes an aperture 52 therethrough which is aligned with the aperture 48 in the card 46. The circumference of the aperture 52 in the rubber sheet 50 is less than the circumference of the aperture 48 in the card 46 which forms a rubber seal 53, which will be discussed in detail below.

As shown best in FIGS. 2, 5, 6 and 7, the vacuum cleaner is also provided with a bag holder 54 for releasably retaining filter bag 42. The bag holder 54 may be a molded plastic member having a curved or arched second top wall 56, a rounded connecting side wall 58 and a first bottom wall 60. The top wall 56 and rounded side wall 58 are constructed so that the dimensions are similar to but less than the dimensions of the upper chamber 34 so that the holder 54 fits fairly closely against the interior surfaces of the vacuum chamber 34. The dimensions of the bottom wall 60 are slightly less than the dimensions of the partition 30. The bottom wall 60 includes a plurality of raised ribs 62 depending therefrom. As shown in FIG. 2, the bag holder 54 is disposed in the upper chamber and sits on top of the secondary divider 30 and filter 32. The ribs 62 provide a space between the bag holder 54 and the divider 30 to provide a clearance so air can be sucked through the divider 30 when the vacuum 10 is in use. The ribs 62 also serve to secure the secondary filter 32 to first partition 30. Free peripheral edges 59 of the top wall 56 and side wall 58 are preferably tapered or rounded so that there is no sharp edge or step between the bag holder and the interior walls of the vacuum chamber which might cause tearing of the bag 42.

The top wall 56 of the bag holder 54 includes an arched card slot 64 for releasably receiving the card 46 of the bag 42. The card slot 64 has two substantially parallel grooves 66 and 68 for receiving the card 46 of the bag 42. Further, the card slot has a raised cross member 67 between the parallel grooves 66 and 68. The raised cross member 67 can be easily grasped by the user's fingers. As indicated above, the card 46 of the bag 42 has a curved end. This curved end makes the insertion of the card 46 into the slot 64 easier.

The vacuum cleaner is also provided with an inner dome or vacuum lid or closure 70 which is positioned over the bag holder 54 and covers the mouth of the housing 12. In the present embodiment, as shown best in FIGS. 2, 3, 4 and 10, the dome lid 70 is made of a preferably clear material, such as glass or acrylic, so the user can see the filter bag 42 when the cleaner 10 is in use. However, it is understood that dome lid 70 can be made out of a variety of suitable materials. As shown best in FIGS. 2 and 10, the dome lid 70 includes a peripheral flange 71 which extends around the rim 16 of the housing 12 to effectively seal the upper chamber 34 when the vacuum cleaner is in use. When the vacuum cleaner is not in use, the decorative lid 20 covers the dome lid 70 as shown in FIG. 2.

The dome or closure 70 is constructed so that it has a raised portion 72 which corresponds to the curved top wall 56 of the bag holder 54. The raised portion 72 of the dome 70 includes a nozzle inlet 74 which extends therethrough and a cylindrical nozzle fitting 76 extending from the bottom thereof. The nozzle fitting 76 is positioned so that it is releasably insertable through the card slot 64 of bag holder 54 and into the seal 53 of the card 46.

The arched card slot 64 causes the card to assume an arched shape which makes the card 46 stiffer so that when the nozzle 76 is inserted through the seal 53 in the card 46, as will be discussed below, the card 46 will not collapse, permitting a tighter seal between the nozzle 76 and the card 46.

Figure 10:
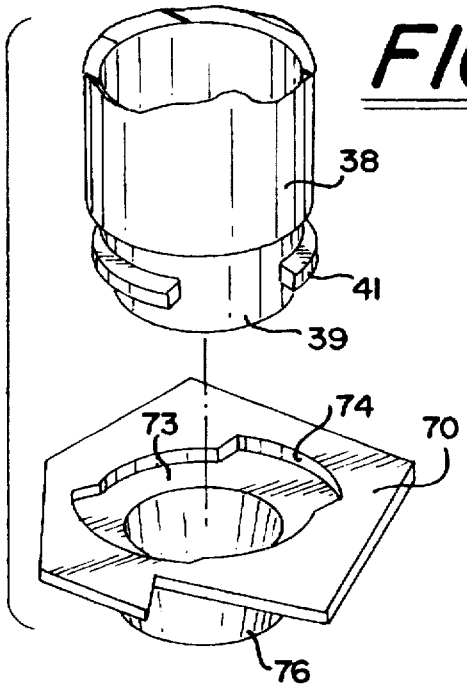
FIG. 10 is an exploded fragmentary view of a hose cuff and mating locking entry connection of the inner dome cover.
Figure 12:
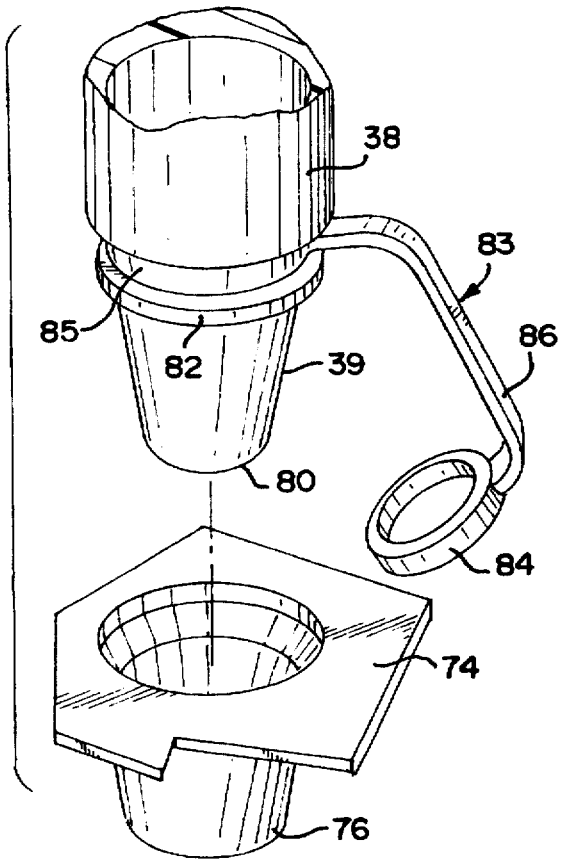

As shown in FIGS. 10 and 12, when the cleaner 10 is in use, the hose cuff 38 of the hose 37 is releasably inserted into the nozzle inlet 74 of the inner cover. As shown best in FIG. 10, in one embodiment of this invention, the hose cuff 38 includes a reduced cylindrical portion 39 at one end thereof. The reduced portion 39 has a locking flange 41 which extends outwardly therefrom and is cooperable with a flange 73 on the raised portion of inner dome lid 70 to provide a quick release connection when the hose cuff 38 is inserted. The hose cuff 38 can be releasably locked in place by turning the hose cuff after insertion.

In the second embodiment of this invention, as shown in FIG. 12, reduced cylindrical portion 39 of hose cuff 38 includes a tapered end 80. Further, in the second embodiment, the nozzle fitting 76 is internally tapered for frictionally releasably receiving the tapered end 80 of the hose cuff 38.

As shown in FIG. 12, the hose cuff 38 can also include a retaining ring 82 around reduced portion 39 and a removable cap member 83. The removable cap member 83 includes a cap 84 and a flexible securing member 85 which can be easily snapped over the retaining ring 82 and around reduced portion 39 and a flexible arm 86 for securing said cap 84 to said securing member 85. When not in use the cap 84 can be releasably secured to the end of the nozzle fitting 76 to prevent ash or dust from falling out. Although the removable cap member 83 is only shown in the second embodiment of FIG. 12, it is understood that it can also be used in connection with the first embodiment of FIG. 10.

When the user has completed vacuuming the fireplace, the cleaner is turned off and the hose cuff is removed. The user can look through the clear dome lid or closure 70 to determine if the bag 42 is full. If the bag 42 is full, the user can place a plastic cap 78 in the bag card opening and through the rubber seal 53. As shown in FIG. 11, the plastic cap extends through the bag inlet and rubber seal 53. The bag holder and bag can then be removed from the cleaner 10 and can be easily carried to the garbage refuge so that the bag can be disposed of without spilling ash or dust. As indicated above, the user can easily grasp cross member 67 when removing and carrying the bag holder.

While a preferred embodiment of the present invention has been shown and described herein, many structural details may be changed without departing from the spirit and scope of the appended claims. It is to be understood that the bag holder 54 as well as other features of the illustrated embodiments may be incorporated in various styles and structure of vacuum cleaners.

The invention is claimed as follows:

1. A vacuum cleaner machine comprising: a housing having an open end, at least a first vacuum chamber and a second chamber, a bag holder removably positioned in said first vacuum chamber for removably retaining a bag having an inlet, a dome positioned over said open end of said housing and said bag holder, a nozzle fitting connected to and extending from said dome for communicating with said inlet in said bag, a vacuum hose having a hose cuff at one end thereof releasably insertable into said nozzle fitting, a suction unit mounted in said second chamber and having an inlet communicating with said vacuum chamber.

2. A vacuum cleaner machine of claim 1, said housing includes a first partition member and a second partition member, and a second vacuum chamber between said first and second partition members.

3. A vacuum cleaner machine of claim 2 wherein said bag holder is removable from said housing for inserting and removing said bag.

4. A vacuum cleaner machine of claim 2, wherein said machine includes a filter positioned on top of said first partition for filtering any dust or ash that may escape from said bag.

5. A vacuum cleaner machine of claim 1, wherein said bag includes a card attached thereto, a flexible sheet secured to said card for providing a seal around said nozzle fitting, said card and said sheet having apertures therethrough for releasably receiving said nozzle fitting, said through aperture of said flexible sheet having a circumference less than the circumference of the through aperture of said card for releasably and sealably receiving said nozzle fitting.

6. A vacuum cleaner machine of claim 5 wherein said bag holder includes an arched card slot wherein a pair of substantially parallel grooves define said card slot for releasably receiving and arching said card of said bag.

7. A vacuum cleaner machine of claim wherein said bag holder includes a raised cross member between said parallel grooves which can be easily grasped by the user's fingers.

8. A vacuum cleaner machine of claim 1, wherein said bag holder includes a first wall a second wall having an arched card slot, and a connecting wall between said first and second walls.

9. A vacuum cleaner machine of claim 8, wherein said hose cuff includes a reduced end portion for releasably locking said hose cuff with said nozzle fitting for securing said vacuum hose when the vacuum cleaner machine is in use.

10. A vacuum cleaner machine of claim 9, wherein said bag includes a card attached thereto, a flexible sheet secured to said card for providing a seal around said nozzle fitting, said card and said sheet having apertures therethrough for releasably receiving said nozzle fitting, said vacuum cleaner machine includes a cap for releasably closing said apertures in said flexible sheet and said card when the vacuum cleaner machine is not in use.

11. A vacuum cleaner machine of claim 1 wherein said hose cuff includes a removable cap releasably attached thereto.

12. A vacuum cleaner machine comprising; a cylindrical housing having an open end, an opposite end, at least one perforated partition between a first vacuum chamber and a second chamber, a flexible vacuum hose, a removable bag holder positioned in said first vacuum chamber, a dust bag releasably connected to said bag holder, said dust bag having a card secured thereto and having an aperture therethrough, and a dome lid positioned over said bag holder and over said open end of said housing, said dome lid having an inlet aperture therethrough with a cylindrical nozzle fitting extending therefrom, said cylindrical nozzle fitting aligning and communicating with said aperture in said card, said vacuum hose having a hose cuff at one end thereof releasably inserted into said nozzle fitting, and a suction unit mounted in said second chamber and having an inlet communicating with said first vacuum chamber and an outlet communicating with said second chamber.

13. A vacuum cleaner machine of claim 12 wherein said housing includes a second partition, and a second vacuum chamber between said first and second partitions.

14. A vacuum cleaner machine of claim 12, wherein said hose cuff includes a reduced end portion therefrom for releasably locking said hose cuff to said nozzle fitting for securing said hose cuff when said vacuum cleaner is in use.

15. A vacuum cleaner machine of claim 12, wherein said bag card includes a flexible sheet secured thereto so that said sheet stretches and seals around said nozzle fitting, said card and said sheet having apertures therethrough for releasably receiving said nozzle fitting of said dome lid, said through aperture of said flexible sheet having a circumference less than the circumference of the through aperture of said card for releasably receiving said nozzle fitting.

16. A vacuum cleaner machine of claim 15, wherein said vacuum cleaner machine includes a cap for releasably closing said aperture in said flexible sheet and card once the machine is not in use.

17. A vacuum cleaner machine of claim 12, wherein said bag holder includes an arched card slot wherein parallel grooves define said card slot for releasably receiving said card of said bag.

18. A vacuum cleaner machine of claim 17 wherein said bag holder includes a raised cross member between said grooves which can be easily grasped by the user's fingers.

19. A vacuum cleaner machine of claim 17, wherein said card includes a rounded end portion for insertion into said grooves of said card slot in said bag.

20. A vacuum cleaner machine of claim 12, wherein said bag holder includes a first wall, a second wall having an arched card slot, and a connecting wall between the first and second walls, said first wall including at least one rib for separating said bag holder from said first partition to create a clearance so air can be sucked through when the vacuum cleaner machine is in use.

21. A vacuum cleaner machine of claim 1, further including a decorative lid for covering at least the nozzle fitting of said vacuum cleaner machine when said vacuum cleaner machine is not in use.

22. A vacuum cleaner machine of claim 1, wherein edges of said bag holder closely conform to interior surfaces of said first vacuum chamber so as to avoid a sharp step which might cause tearing of the bag.

23. A vacuum cleaner machine as defined in claim 1, wherein said bag holder comprises a first wall for supporting one end of said bag, said bag having an opposite end including an apertured bag card for communication with said vacuum hose, said bag holder further comprising a second wall opposite said first wall and a side wall connecting said first and second walls, said bag holder having an opening therein for the insertion and removal of said bag with respect to said bag holder, and said second wall including means defining a slot for removably receiving said apertured bag card for operative connection with said vacuum hose.

24. A vacuum cleaner machine of claim 23, wherein said means defining said slot is arched for retaining and arching said bag card for facilitating connection with a vacuum hose.

* * * * *

UNITED STATES PATENT AND TRADEMARK OFFICE

CERTIFICATE OF CORRECTION

PATENT NO. : 5,778,487
DATED : July 14, 1998
INVENTOR(S) : Ernest R. Schuld

It is certified that error appears in the above-indentified patent and that said Letters Patent is hereby corrected as shown below:

Column 5, Line 36 "of claim wherein" should be -- of claim 6 wherein --

Signed and Sealed this

Twenty-sixth Day of January, 1999

*Attest:*

*Attesting Officer*

*Acting Commissioner of Patents and Trademarks*